US007784240B2

(12) United States Patent
Miller

(10) Patent No.: US 7,784,240 B2
(45) Date of Patent: Aug. 31, 2010

(54) MODULAR TRACK SYSTEM FOR EXTERIOR DECORATIVE TRIM

(76) Inventor: Robert C. Miller, 123 Dawn Valley Dr., Hendersonville, NC (US) 28792

( * ) Notice: Subject to any disclaimer, the term of this patent is extended or adjusted under 35 U.S.C. 154(b) by 363 days.

(21) Appl. No.: 12/009,506

(22) Filed: Jan. 18, 2008

(65) Prior Publication Data

US 2008/0172977 A1 Jul. 24, 2008

Related U.S. Application Data

(60) Provisional application No. 60/881,295, filed on Jan. 19, 2007.

(51) Int. Cl.
*E04C 5/00* (2006.01)

(52) U.S. Cl. ..... 52/710; 52/716.1; 52/184; 256/65.01

(58) Field of Classification Search ..... 52/184, 52/185, 187, 710, 632, 716–717.06; 256/65.01, 256/67

See application file for complete search history.

(56) References Cited

U.S. PATENT DOCUMENTS

| | | | | |
|---|---|---|---|---|
| 303,356 | A | | 8/1884 | Beck |
| 1,933,691 | A | | 11/1933 | Young |
| 3,113,760 | A | | 12/1963 | Huret et al. |
| 3,388,523 | A | * | 6/1968 | Evans ..... 52/716.5 |
| 4,083,592 | A | * | 4/1978 | Rubin et al. ..... 52/717.05 |
| 4,112,195 | A | * | 9/1978 | Pott et al. ..... 52/717.04 |
| 4,346,872 | A | * | 8/1982 | Tornya ..... 256/65.02 |
| 4,843,783 | A | | 7/1989 | Taravella |
| 5,444,956 | A | | 8/1995 | Searer et al. |
| 5,523,529 | A | * | 6/1996 | Holliday ..... 174/101 |
| 5,564,233 | A | | 10/1996 | Norton |
| 5,572,845 | A | | 11/1996 | DeSouza |
| 5,694,726 | A | | 12/1997 | Wu |
| 6,421,964 | B1 | | 7/2002 | Schiedegger et al. |

* cited by examiner

*Primary Examiner*—Richard E Chilcot, Jr.
*Assistant Examiner*—William V Gilbert
(74) *Attorney, Agent, or Firm*—McNair Law Firm, P.A.; Seann P. Lahey

(57) ABSTRACT

A modular exterior decorative track molding assembly including a securing track having a base section including a first channel portion, and a securing section including a second channel portion; the securing section having securing lips and a narrowed width relative to the base section; a trim module having a support rail carrying a decorative trim element received in the securing track; the support rail having a complementary shape to the base section and the securing section and including retaining channels receiving the securing lips of the securing track to resist separation between the securing track and the support rail; and, a trim element base included in the support rail carrying a decorative trim element and disposed between the retaining channels, wherein the trim element base extends through a trim module opening of the securing track.

20 Claims, 9 Drawing Sheets

MODULAR TRACK SYSTEM FOR EXTERIOR DECORATIVE TRIM

CROSS REFERENCE TO RELATED APPLICATION

This application claims priority of Provisional Application Ser. No. 60/881,295, filed Jan. 19, 2007.

BACKGROUND OF THE INVENTION

1) Field of the Invention

The present invention relates to a durable and lightweight track system for hanging exterior decorative trim moldings on a residential or commercial building to provide decorative accents to the structure's exterior for improving the facade. The track system allows for mixing and matching of various prefabricated modular decorative trim elements that are inserted into the track system in a sliding arrangement for quick and simple installation.

2) Description of Related Art

The do-it-yourself industry is becoming ever more popular as innovations in home improvement products make using the products significantly more user friendly for the average consumer. One area, however, where such improvements have not been made for the do-it-yourselfer is in the area of exterior decorative housing trim.

Currently, high quality decorative trim must be handcrafted, typically from wood, and installed by professionals using nails, staples and glue in a complicated and time consuming process. This traditional installation using nails, staples and glue, requires the added steps of patching over nail holes with putty, sanding, and painting or staining the wood, which represents a significant cost in terms of labor and the time required to install such moldings. Due to the high costs of having such decorative trim handcrafted and installed by skilled professional home builders, usually only more expensive homes have this type of decorative trim installed. Further, traditional exterior architectural decorative moldings manufactured from wood are subject to shrinkage, warping and splitting from exposure to the elements which can give rise to significant maintenance costs. A further disadvantage of traditional wood moldings is that they are not removably secured, but rather intended to be permanently attached. Thus, there is no ability to interchange designs over time without completely uninstalling and reinstalling all the trim, which is entirely cost prohibitive.

U.S. Pat. No. 6,421,964 discloses a decorative molding assembly. This system must be attached to a wall of the structure and cannot hang freely from a railing or other exterior trim. While the moldings are interchangeable, the application is limited due to the method of attachment, and thus, the system is unable to install many types of desirable molding.

U.S. Pat. No. 5,563,233 discloses a decorative molding assembly that is limited to a particular arrangement of crown molding with a dental molding insert. This system must also be attached to a wall of the structure and cannot hang freely from other exterior ledges, railings or fascia boards.

Other similar decorative molding assemblies exist that suffer from the same problems of limited application due to the method of attachment.

Accordingly, it is an object of the present invention to provide a lightweight track system for hanging exterior decorative trim moldings on a residential or commercial building to provide decorative accents to the structures exterior for improving the facade.

It is a further object of the present invention to provide a track system that allows for mixing and matching of various prefabricated modular decorative trim pieces that can be inserted into the tracks in a sliding arrangement for quick and simple installation or removal.

It is a further object of the present invention to provide a modular exterior molding track system that is cost efficient to manufacture and install, which avoids the maintenance issues associated with typical wood construction.

It is a further object of the present invention to provide a modular exterior molding track system that can be installed to hang freely from exterior ledges, railings or fascia boards to provide a broad range of decorative accent options.

SUMMARY OF THE INVENTION

The above objectives are accomplished according to the present invention by providing a modular exterior decorative track molding assembly comprising: a securing track for attachment to a structure exterior; said securing track comprising: a base section having a pair of parallel base sidewalls interconnected by a horizontally extending base end wall perpendicular to said base sidewalls, wherein said base sidewalls and base end wall define a first channel portion; a securing section having a pair of symmetrical securing sidewalls extending from said base sidewalls of said base section to define a second channel portion, wherein said securing sidewalls are recessed from said base sidewalls so that an exterior side of said securing sidewalls is carried adjacent and continuous with an interior side of said base sidewalls; a first securing lip and a second securing lip included in said securing section extending parallel to said base sidewalls into said second channel portion of said securing section; a trim module opening defined between said first securing lip and said second securing lip; and, a retaining ledge included in said securing track disposed at the intersection of said base section and said securing section being formed by a distal end of each of said securing sidewalls recessed from said base sidewalls; a trim module having a support rail carrying a decorative trim element, wherein said support rail is received in said securing track in sliding engagement so that said trim module is locatable at any position along said securing track; said support rail comprising: a base insert section received in said first channel portion of said base section having a complementary shape to said base section for flush engagement with said base sidewalls and said base end wall; a securing insert section received in said second channel portion of said securing section having a complementary shape to said securing section for flush engagement with said securing sidewalls; wherein said securing insert section is recessed from said base insert section in a complementary arrangement to said securing track to define a support ledge at the intersection of said base insert section and said securing insert section so that said retaining ledge engages said support ledge to retain said base insert section in said first channel portion of said securing track; a first retaining channel carried by said securing insert section receiving said first securing lip of said securing track, and a second retaining channel carried by said securing insert section receiving said second securing lip to resist separation between said securing track and said support rail; and, a trim element base defined between said first retaining channel and said second retaining channel, wherein said trim element base extends through said trim module opening of said securing track and carrying said decorative trim element.

In a further embodiment, the symmetrical securing sidewalls of said securing track are rounded inward from said base sidewalls to form a shoulder recess between said base section and said first securing lip and said second securing lip, respectively, on opposing sides of said securing track.

In a further embodiment, the securing insert section has a complementary rounded shape to said securing sidewalls of said securing track to form a rounded shoulder for being received in said shoulder recess in flush engagement.

In a further embodiment, a second support rail is carried at an opposite distal end of said decorative trim element in an inverted orientation to the first said support rail for engaging a securing track so that said trim module includes a top support rail and a bottom support rail.

In a further embodiment, a double track is provided having a first securing track and a second securing track symmetrically arranged back to back so that said trim module opening of said first securing track is disposed on a top side and said trim module opening of said second securing track is disposed on a bottom side.

In a further embodiment, the first securing track of said double track engages said bottom support rail of said trim module so that said top rail of another said trim module can be inserted into said second securing track for a double hung arrangement.

In a further embodiment, an end cap is provided for being carried at a distal end of said securing track to resist said trim module from sliding out of said securing track.

In a further embodiment, the end cap includes a cap insert portion having a complementary shape to said base section and said securing section for being received in said first and second channel portions of said securing track in a friction fit arrangement.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
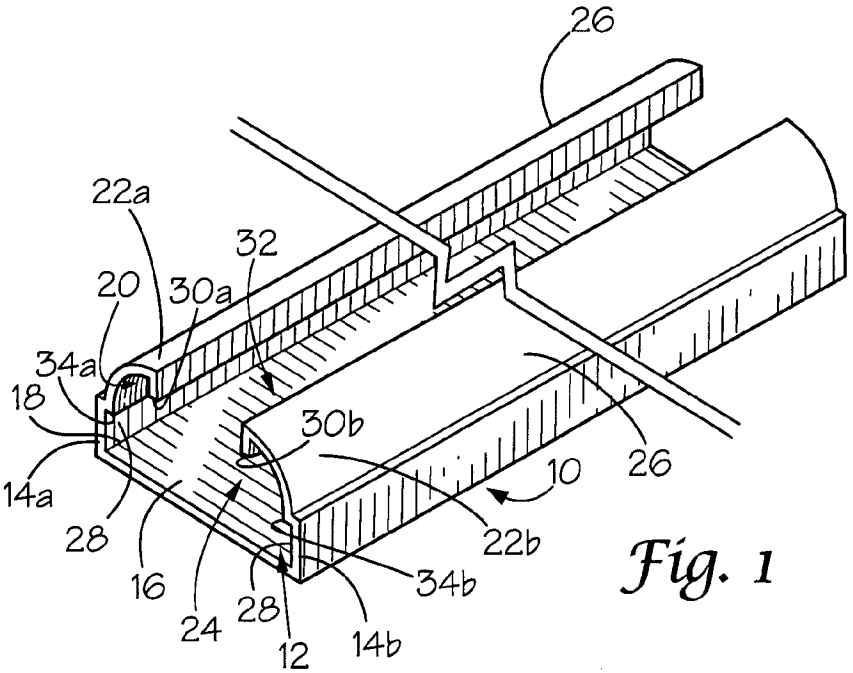
FIG. 1 shows a perspective view of a securing track according to the present invention.

With reference to the drawings, the invention will now be described in more detail. Referring to FIG. 1, a securing track designated generally as 10, is shown in a perspective view. The securing track provides the basic means for attaching decorative trim modules to the exterior of a building. The securing track may be attached by any of various means such as screws, nails, staples, glue, or other well-known means commonly used by those skilled in the art.

Securing track 10 includes a base section, designated generally as 12, having a pair of parallel base sidewalls 14*a* and 14*b* interconnected by a horizontally extending base end wall 16 perpendicular to base sidewalls 14*a* and 14*b*. Base sidewalls 14*a* and 14*b* and base end wall 16 define a first channel portion, designated generally as 18, of securing track 10.

Securing track 10 includes a securing section, designated generally as 20, adjacent base section 12. Securing section 20 is defined by a pair of symmetrical securing sidewalls 22*a* and 22*b* extending from base sidewalls 14*a* and 14*b*, respectively, of base section 12 to define a second channel portion, designated generally as 24, of securing track 10. Securing sidewalls 22*a* and 22*b* are laterally recessed from base sidewalls 14*a* and 14*b* so that an exterior side 26 of securing sidewalls 22*a* and 22*b* is carried adjacent and continuous with an interior side 28 of base sidewalls 14*a* and 14*b*. Preferably, securing track 10 is a solid molded track so that base section 12 and securing section 20 are formed together and are continuous in their arrangement:

Securing track 10 further includes a first securing lip 30*a* and a second securing lip 30*b* included in securing section 20, each extending in a parallel direction to base sidewalls 14*a* and 14*b* into the space of second channel portion 24.

Securing track 10 also includes a trim module opening 32 defined between first securing lip 30*a* and the second securing lip 30*b* for receiving the trim modules described in detail herein below.

Retaining ledges 34*a* and 34*b* are defined in securing track 10 disposed at the intersection of base section 12 and securing section 20 being formed by a distal end of each of securing sidewalls 22*a* and 22*b* being recessed and laterally offset inwardly from base sidewalls 14*a* and 14*b*.

Figure 4:
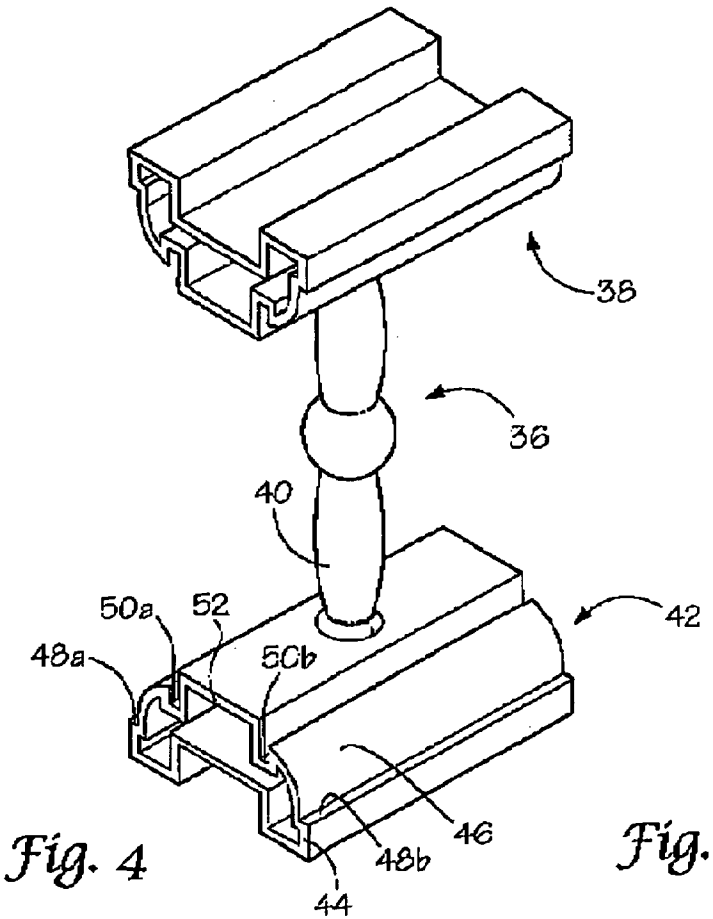
FIG. 4 shows a perspective view of a trim module according to the present invention.
Figure 7:
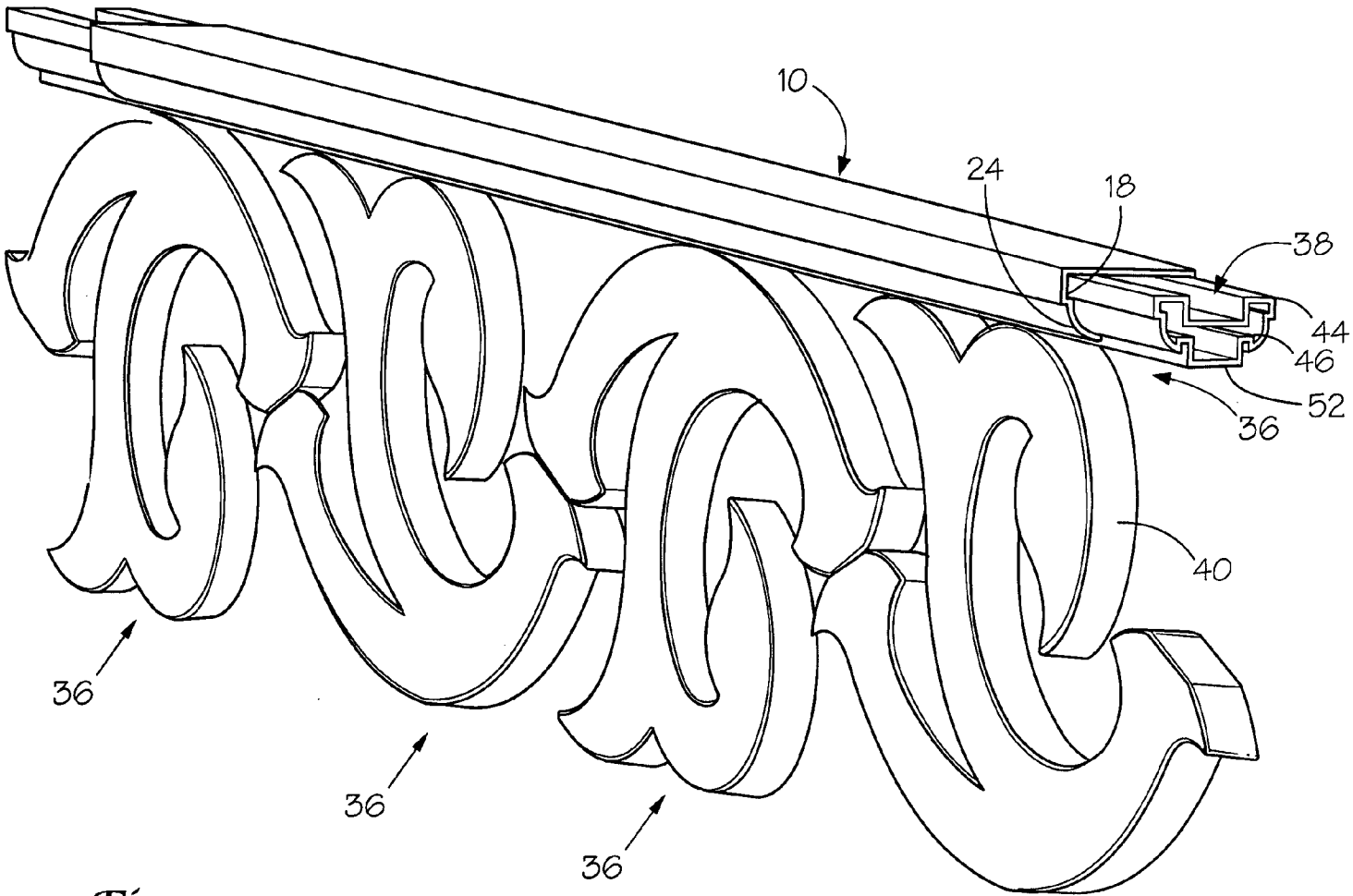
FIG. 7 shows a perspective view of an alternative arrangement of trim module inserted into the securing track.

Referring to FIGS. 4 and 7, a trim module, designated generally as 36 is shown in perspective view for engaging securing track 10. Trim module 36 includes a support rail, designated generally as 38, carrying a decorative trim element 40, wherein support rail 38 is received in securing track 10 in sliding engagement so that trim module 36 is locatable at any position along securing track 10. Preferably, as shown in FIG. 4, trim module 36 includes a top support rail 38 and a bottom support rail 42 interconnected by decorative trim element 40. Decorative trim element 40 could be virtually any shape and size and may be carried by a single support railing 38 or 42 (as shown in FIG. 7) for coupling with securing track 10, as opposed to the double railing featured in FIG. 4. The illustrated embodiment in FIG. 4 includes both a top and bottom support rail as it is desirable for certain installation applications and desired looks, and can be utilized in a double-hung type arrangement as described in detail herein below.

Figure 2:
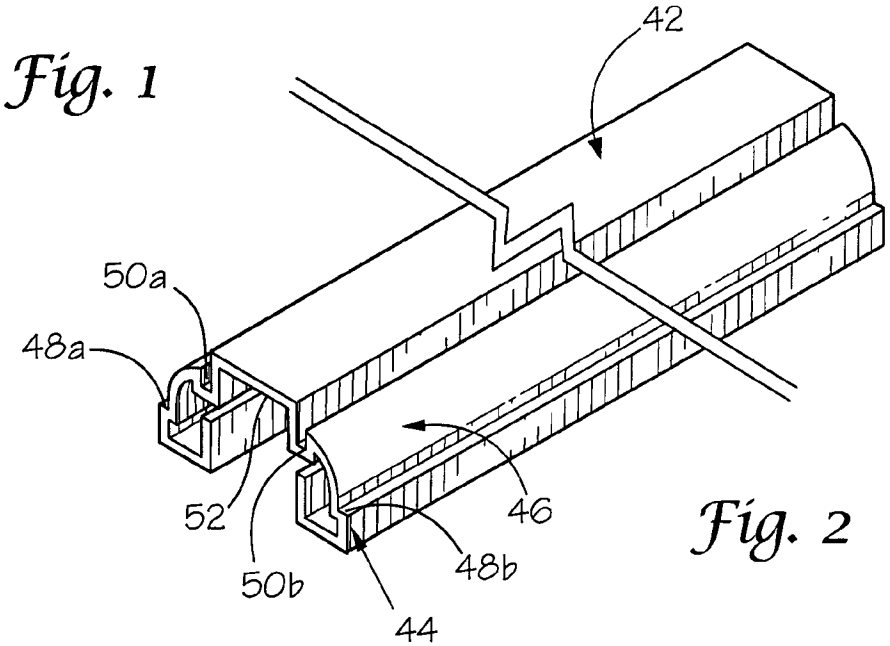
FIG. 2 shows a perspective view of a support rail section of a trim module according to the present invention.

Referring to FIG. 2, bottom support rail 42 is shown in perspective view, which is inserted into securing track 10. The structural description herein below for bottom support rail 42 applies to top support rail 38 as well. Support rail 42 has a generally corresponding shape to the interior of securing track 10 to provide secure engagement between securing track 10 and support rail 42. Support rail 42 includes a base insert section, designated generally as 44, received in first channel portion 18 of base section 12 in securing track 10. Base insert section 44 has a complementary shape to base section 12 for flush engagement with base sidewalls 14*a* and 14*b* and base end wall 16.

Support rail 42 includes a securing insert section, designated generally as 46, received in second channel portion 24 of securing section 20 in securing track 10. Securing insert section 46 also has a complementary shape to securing section 20 of securing track 10 for flush engagement with securing sidewalls 22*a* and 22*b*.

To conform to the interior shape of securing track 10, securing insert section 46 is laterally recessed from base insert section 44 in a complementary arrangement to securing track 10 to define support ledges 48*a* and 48*b* at the intersection of base insert section 44 and securing insert section 46. In this arrangement, when engaged with securing track 10, retaining ledges 34*a* and 34*b* engage support ledges 48*a* and 48*b* to retain base insert section 44 in first channel portion 18 of securing track 10.

Support rail 42 further includes a first retaining channel 50*a* carried by securing insert section 46 which receives first securing lip 30*a* of securing track 10. A second retaining channel 50*b* is carried by securing insert section 46 which receives second securing lip 30*b*. Together, securing lips 30*a* and 30*b* when engaged in retaining channels 50*a* and 50*b* cooperate to resist separation between securing track 10 and the support rail 42.

A trim element base 52 is defined between first retaining channel 50*a* and second retaining channel 50*b*. Trim element base 52 extends through trim module opening 32 of securing track 10 and carries decorative trim element 40 (see FIGS. 4, 5 and 7).

Figure 3:
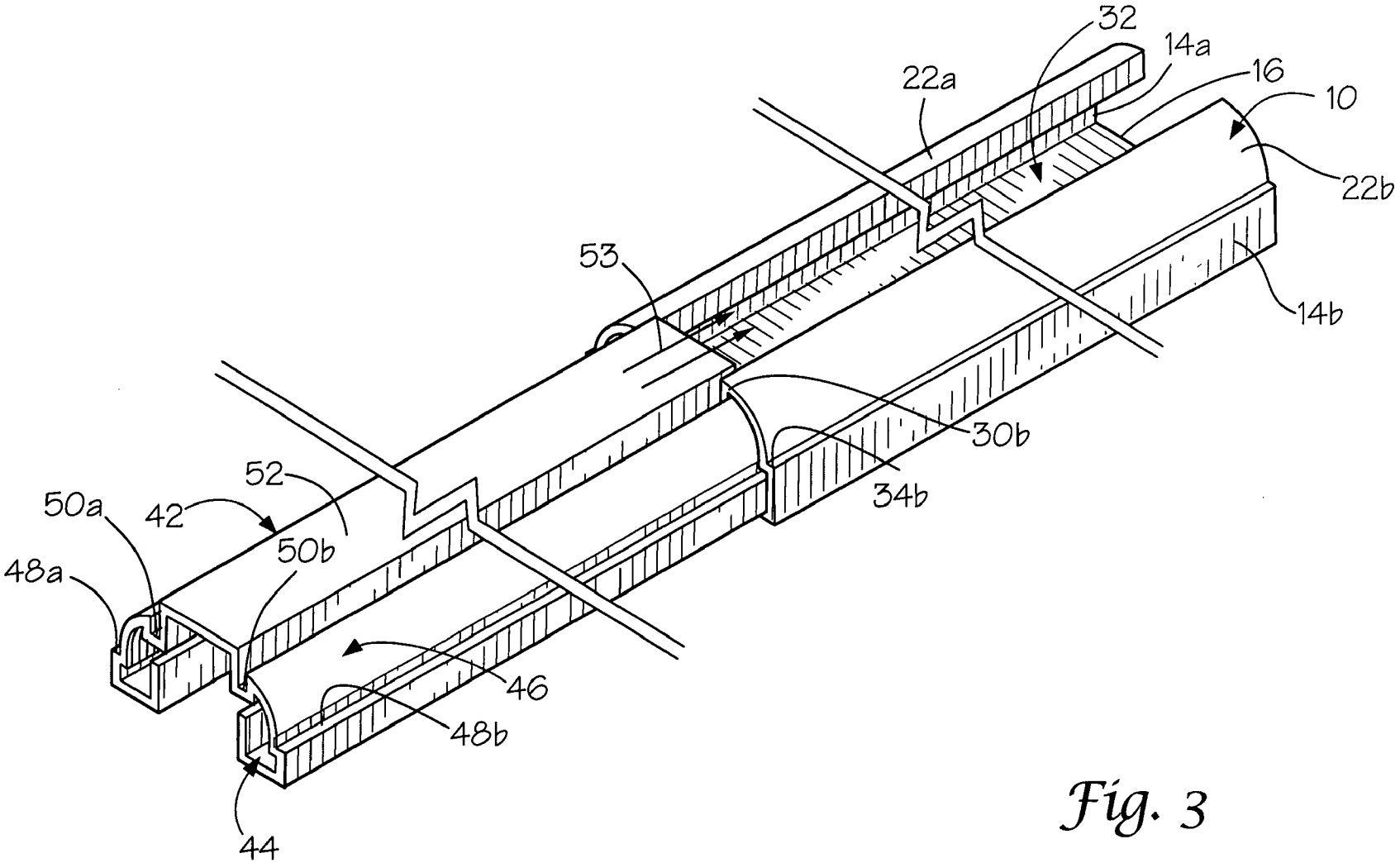
FIG. 3 shows a perspective view of the support rail being received in sliding engagement with the securing track.

Referring to FIG. 3, support rail 14 is shown in a sliding engagement with securing track 10 so that support rail 14 can be slid into and along securing track 10 in direction 53 for complete engagement between the two components.

Figure 5:
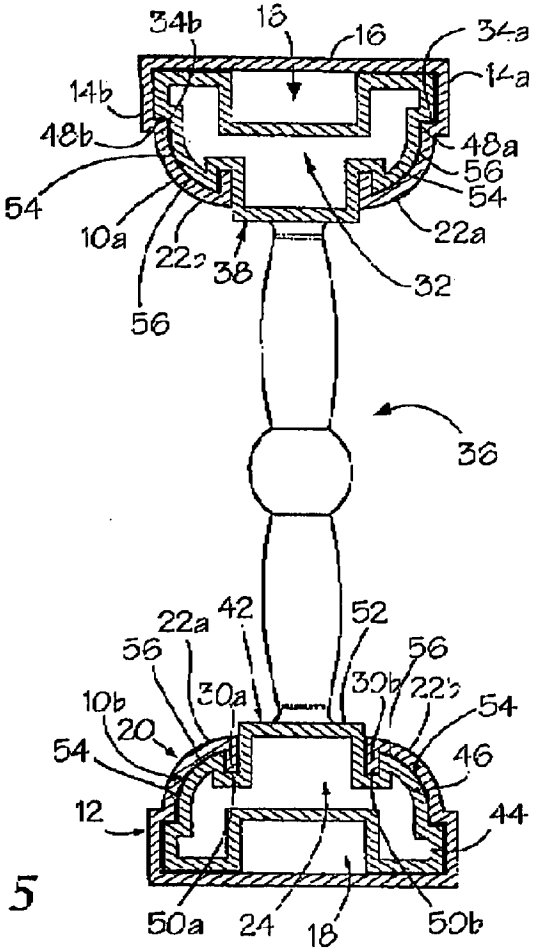
FIG. 5 shows a cross-section view of a trim module received into the securing tracks.

Referring to FIG. 5, a cross-section view is shown of trim module 36 inserted into an upper securing track 10*a* and a lower securing track 10*b*. To allow for insertion of the trim module 36, each securing track 10*a* and 10*b* includes trim module opening 32 between securing lips 30*a* and 30*b* as detailed above. Trim module opening 32 allows for trim modules 36 to slide into securing tracks 10*a* and 10*b* from the distil end of the track, but prevents withdrawing of the trim modules through trim module opening 32 by pulling the trim module upward or downward as opposed to sliding through the track. Further, the symmetrical securing sidewalls 22*a* and 22*b* of securing tracks 10*a* and 10*b* are preferably rounded inward from base sidewalls 14*a* and 14*b* to form a shoulder recess, designated generally as 54, between base section 12 and first securing lip 30*a* and the second securing lip 30*b*, respectively, on opposing sides of securing tracks 10*a* and 10*b*. In complementary arrangement, securing insert section 46 has a rounded shape to securing sidewalls 22*a* and 22*b* of securing tracks 10*a* and 10*b* to form a rounded shoulder 56 for being received in shoulder recess 54 in flush engagement. This helps provide an even weight distribution across the interior of the securing tracks and helps to prevent play between the components so that there is a solid fitting to enhance durability and lifespan by reducing wearing engagement between the components.

As is evident from the figures, the shape of support rails 38 and 42 are complementary to securing tracks 10*a* and 10*b* to provide a solid engagement between the components. Additionally, the engagement of securing lips 30*a* and 30*b* with retaining channels 50*a* and 50*b* prevents separation of the components in the withdrawal of the trim module by any means other than sliding the trim modules out to the distil end of the securing track.

Figure 6:
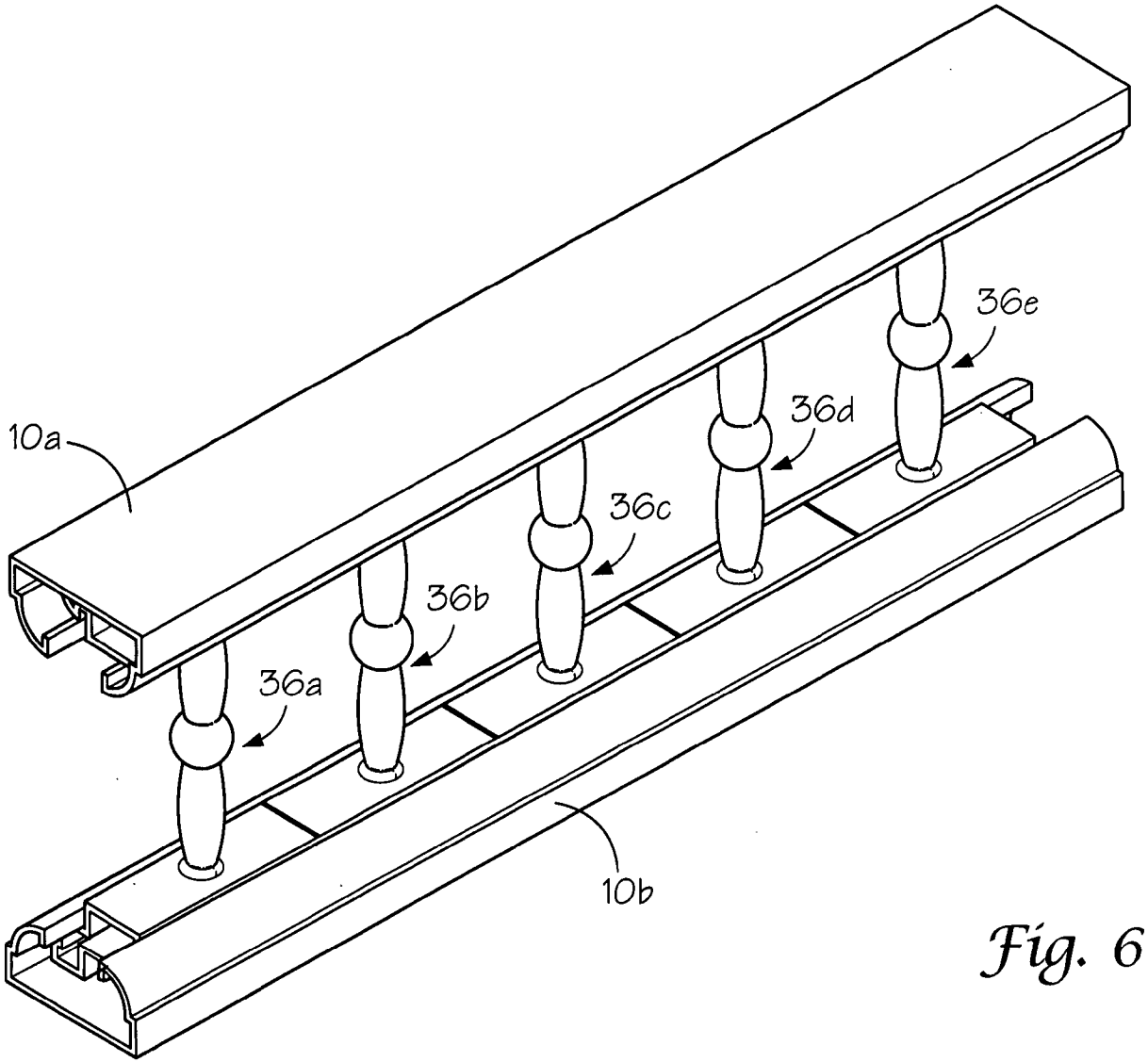
FIG. 6 shows a perspective view of a plurality of trim module carried between securing tracks.

Referring to FIG. 6, a perspective view of a plurality of trim modules 36*a*-36*e* are shown engaged between securing tracks 10*a* and 10*b*. Each of trim modules 36*a*-36*e* is slid individually into place and may be mixed and matched in any of various arrangements, shapes and sizes to provide a desired decorative molding look. This type of flexible arrangement is only possible with the modular construction according to the present invention. Preferably, each of trim modules 36 is kept to a minimum size so that the insertion and arrangement can be accomplished with minimal difficulty. In the arrangement shown in FIGS. 6 and 7, each of the trim modules 36 is represented by a single complete decorative trim element 40, and not the entire repetitive sequence.

Figure 8:
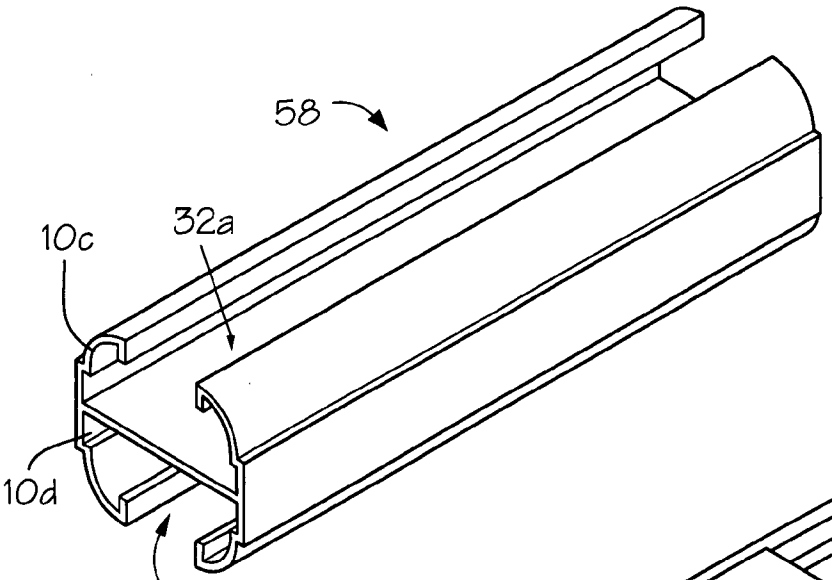
FIG. 8 shows a perspective view of a double track arrangement according to the present invention.
Figure 9:
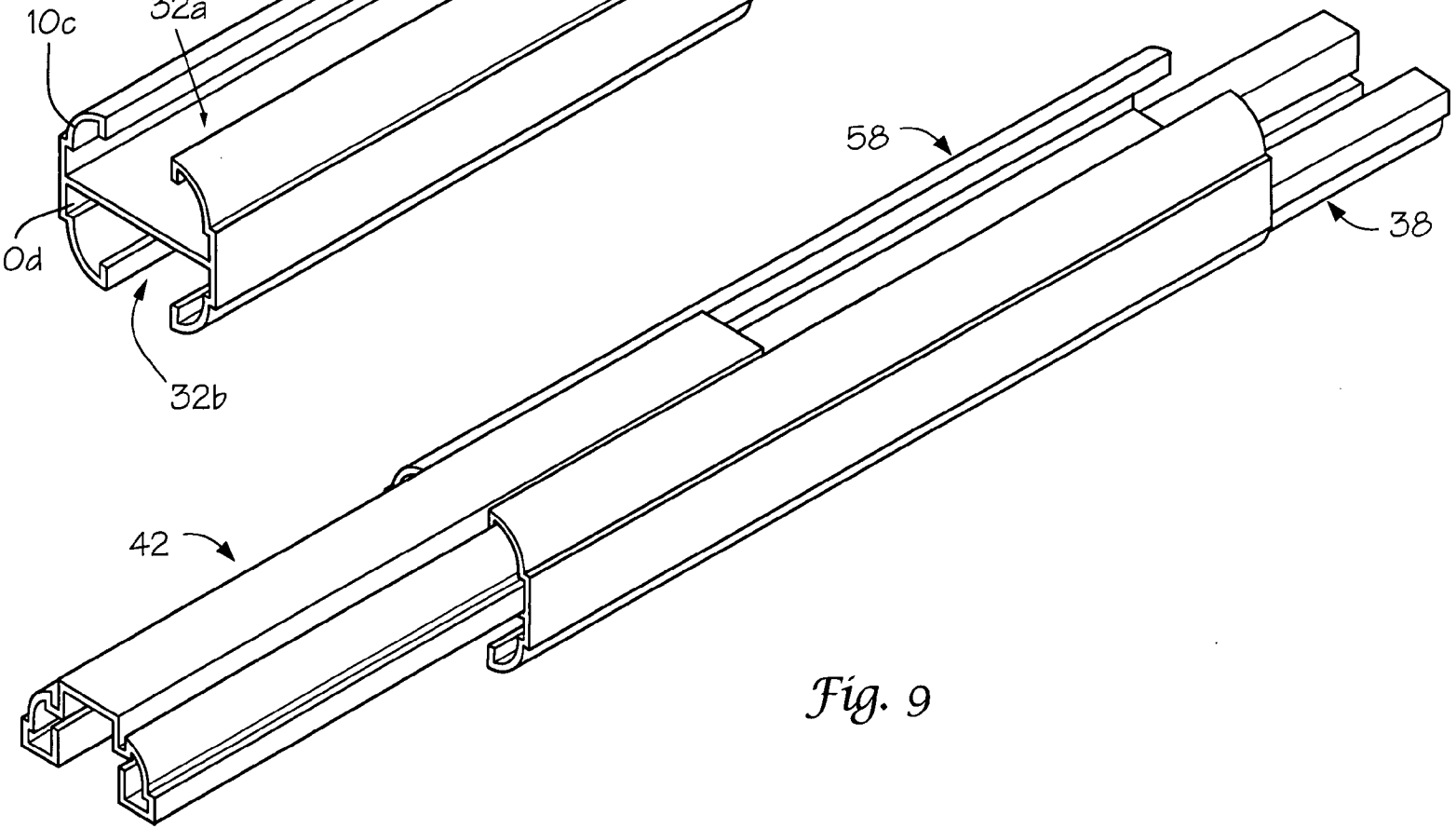
FIG. 9 shows a perspective view of sliding engagement between the double track and support rails of a trim module.
Figure 10:
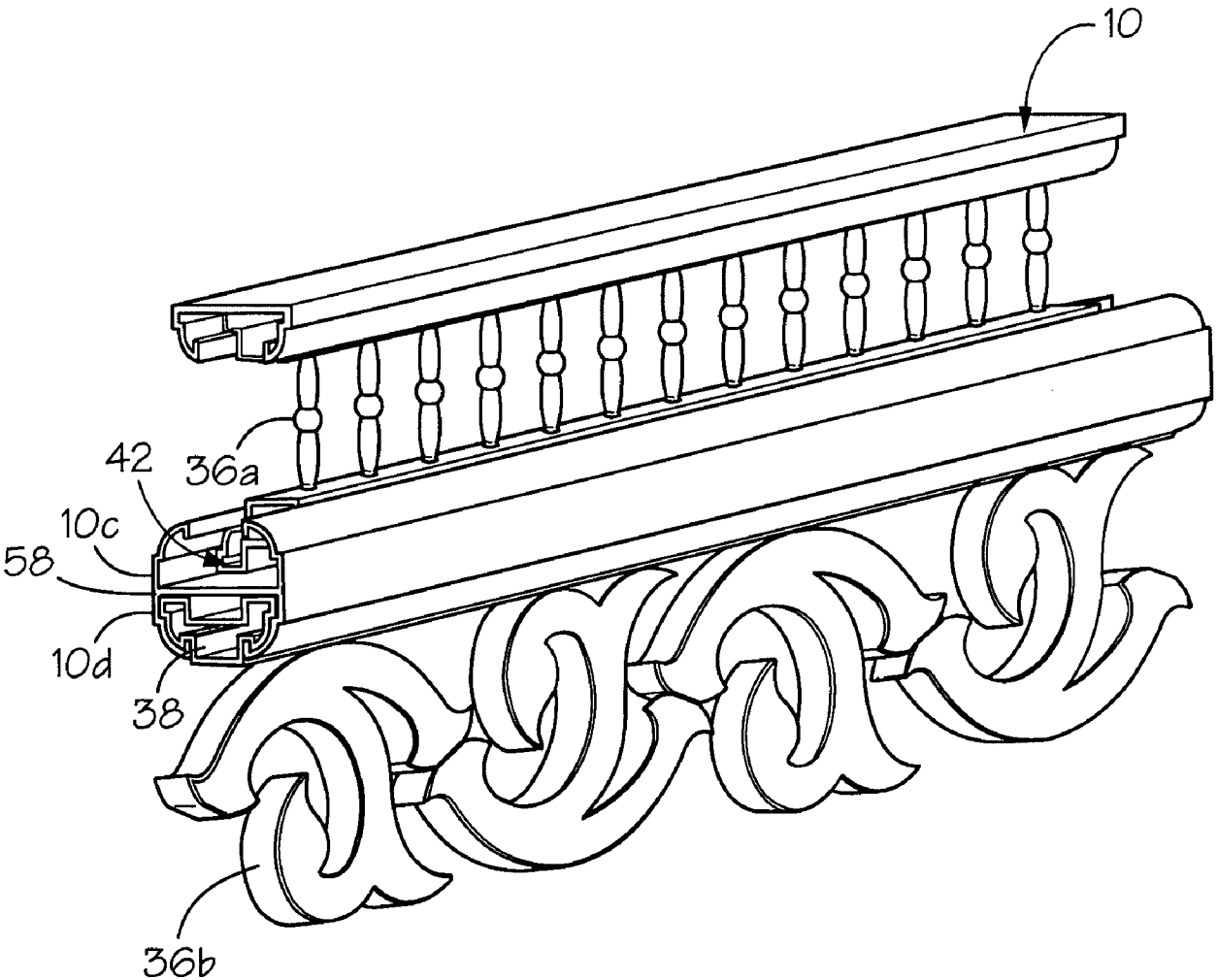
FIG. 10 shows a perspective view of two decorative trim module design types interconnected by the double track.
Figure 11B:
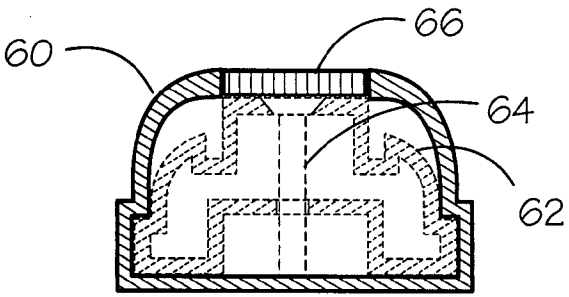
FIG. 11*b* shows a cross-section view of the end cap inserted into a distal end of the securing track according to the present invention.
Figure 11C:
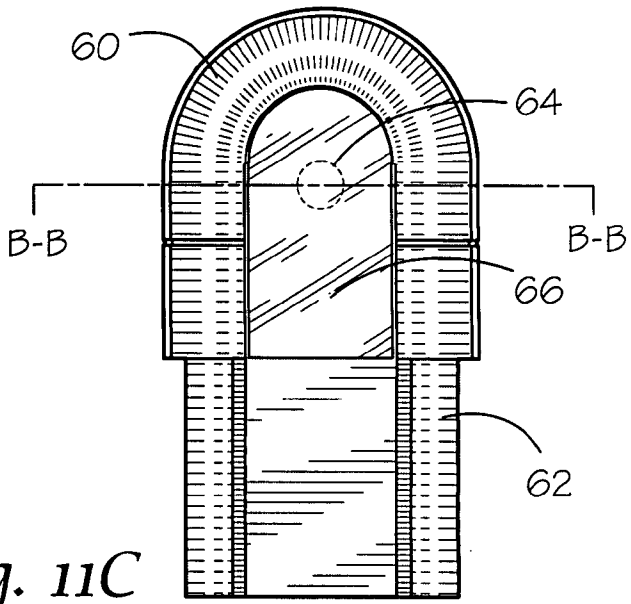
FIG. 11*c* shows a top plan view of the end cap according to the present invention; and, FIG. 12 shows a perspective view of the end cap inserted into the securing track according to the present invention.
Figure 11A:
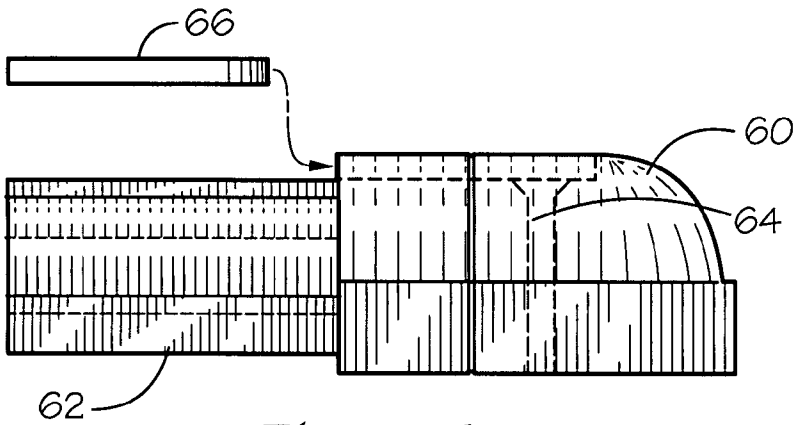
FIGS. 11*a* shows a side view of an end cap for insertion into the securing track according to the present invention.
Figure 12:
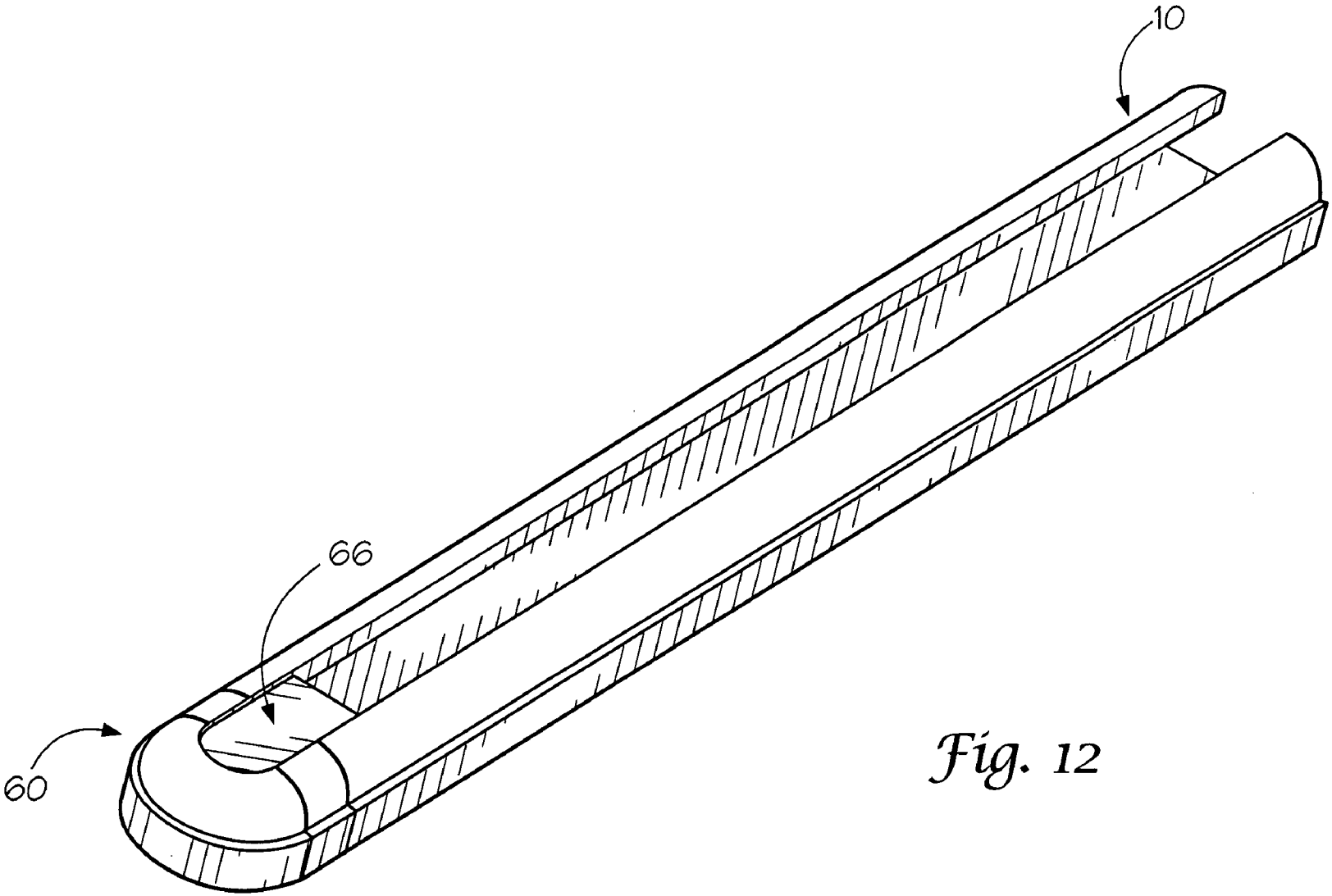

Referring to FIG. 8-10, a double-hung securing track arrangement is shown in perspective view, which illustrates how the modular elements can be combined in a layered manner to mix and match decorative trim elements. Referring to FIG. 8, a double track 58 is shown having a first securing track 10*c* and a second securing track 10*d* symmetrically arranged back to back so that trim module opening 32*a* of first securing track 10*c* is disposed on a top side and trim module opening 32*b* of second securing track 10*d* is disposed on a bottom side. As shown in FIG. 9, double track 58 allows for the insertion of a first support rail 42 into first securing track 10*c* and a second support rail 38 into second securing track 10*d*. Referring to FIG. 10, preferably, first securing track 10*c* of the double track engages bottom support rail 42 of trim module 36*a* so that the top support rail 38 of another trim module 36*b* can be inserted into second securing track 10*d* of double track 58 for a double-hung arrangement.

Referring to FIGS. 11*a*-11*c* and FIG. 12, to provide a nice finish to the distal end of each securing track 10, an end cap 60 is provided which inserts into the securing track to provide a rounded off finish to the end of securing track 10 and prevent the trim modules from accidentally sliding out of securing track 10. End cap 60 is designed with the same arrangement as the support rails to cooperate in secure engagement with securing track 10. End cap 60 includes a cap insert portion 62 having a complementary shape to base section 12 and securing section 20 of securing track 10 for being received in first and second channel portions 18 and 24 of securing track 10 in a friction fit arrangement. A securing member 64 may be used, which may be a screw, nail or other comparable attachment means, that is received through end cap 60 and inserted into the building exterior to prevent removal of end cap 60. A cover piece 66 is also included for insertion into end cap 60 to cover securing member 64 for aesthetic purposes.

While a preferred embodiment of the invention has been described using specific terms, such description is for illustrative purposes only, and it is to be understood that changes and variations may be made without departing from the spirit or scope of the following claims.

What is claimed is:

1. A modular exterior decorative track molding assembly comprising:

a securing track for attachment to a structure exterior; said securing track comprising:

a base section having a pair of parallel base sidewalls interconnected by a horizontally extending base end wall perpendicular to said base sidewalls, wherein said base sidewalls and base end wall define a first channel portion;

a securing section having a pair of symmetrical securing sidewalls extending from said base sidewalls of said base section to define a second channel portion, wherein said securing sidewalls are recessed from said base sidewalls so that an exterior side of said securing sidewalls is carried adjacent and continuous with an interior side of said base sidewalls;

a first securing lip and a second securing lip included in said securing section extending parallel to said base sidewalls into said second channel portion of said securing section;

a trim module opening defined between said first securing lip and said second securing lip; and, a retaining ledge included in said securing track disposed at the intersection of said base section and said securing section being formed by a distal end of each of said securing sidewalls recessed from said base sidewalls;

a trim module having a support rail carrying a decorative trim element, wherein said support rail is received in said securing track in sliding engagement so that said trim module is locatable at any position along said securing track;

said support rail comprising:

a base insert section received in said first channel portion of said base section having a complementary shape to said base section for flush engagement with said base sidewalls and said base end wall;

a securing insert section received in said second channel portion of said securing section having a complementary shape to said securing section for flush engagement with said securing sidewalls; wherein said securing insert section is recessed from said base insert section in a complementary arrangement to said securing track to define a support ledge at the intersection of said base insert section and said securing insert section so that said retaining ledge engages said support ledge to retain said base insert section in said first channel portion of said securing track;

a first retaining channel carried by said securing insert section receiving said first securing lip of said securing track, and a second retaining channel carried by said securing insert section receiving said second securing lip to resist separation between said securing track and said support rail; and, a trim element base defined between said first retaining channel and said second retaining channel, wherein said trim element base extends through said trim module opening of said securing track and carrying said decorative trim element.

2. The assembly of claim 1 wherein said symmetrical securing sidewalls of said securing track are rounded inward from said base sidewalls to form a shoulder recess between said base section and said first securing lip and said second securing lip, respectively, on opposing sides of said securing track.

3. The assembly of claim 2 wherein said securing insert section has a complementary rounded shape to said securing sidewalls of said securing track to form a rounded shoulder for being received in said shoulder recess in flush engagement.

4. The assembly of claim 1 including a second support rail carried at an opposite distal end of said decorative trim element in an inverted orientation to the first said support rail for engaging a securing track so that said trim module includes a top support rail and a bottom support rail.

5. The assembly of claim 4 including a double track having a first securing track and a second securing track symmetrically arranged back to back so that said trim module opening of said first securing track is disposed on a top side and said trim module opening of said second securing track is disposed on a bottom side.

6. The assembly of claim 5 wherein said first securing track of said double track engages said bottom support rail of said trim module so that said top rail of another said trim module can be inserted into said second securing track for a double hung arrangement.

7. The assembly of claim 1 including an end cap for being carried at a distal end of said securing track to resist said trim module from sliding out of said securing track.

8. The assembly of claim 7 wherein said end cap includes a cap insert portion having a complementary shape to said base section and said securing section for being received in said first and second channel portions of said securing track in a friction fit arrangement.

9. A modular exterior decorative track molding assembly comprising:

a securing track for attachment to a structure exterior; said securing track comprising:

a base section including a first channel portion;

a securing section including a second channel portion and having a first securing lip and a second securing lip extending parallel to each other into said second channel portion; said securing section having a narrowed width relative to said base section; and, a trim module opening defined between said first securing lip and said second securing lip;

a trim module having a support rail carrying a decorative trim element, wherein said support rail is received in said securing track in sliding engagement;

said support rail having a complementary shape to said base section and said securing section; said support rail including a first retaining channel receiving said first securing lip of said securing track, and a second retaining channel receiving said second securing lip to resist separation between said securing track and said support rail; and, a trim element base included in said support rail carrying a decorative trim element and disposed between said first retaining channel and said second retaining channel, wherein said trim element base extends through said trim module opening of said securing track.

10. The assembly of claim 9 wherein said base section includes a pair of parallel base sidewalls interconnected by a horizontally extending base end wall perpendicular to said base sidewalls, wherein said base sidewalls and base end wall define said first channel portion.

11. The assembly of claim 10 wherein said securing section includes a pair of symmetrical securing sidewalls extending from said base sidewalls of said base section to define said second channel portion, said securing sidewalls being recessed from said base sidewalls so that an exterior side of said securing sidewalls is carried adjacent and continuous with an interior side of said base sidewalls.

12. The assembly of claim 11 including a retaining ledge disposed at the intersection of said base section and said securing section being formed by a distal end of each of said securing sidewalls recessed from said base sidewalls.

13. The assembly of claim 12 wherein said support rail includes a base insert section received in said first channel portion of said base section having a complementary shape to said base section for flush engagement with said base sidewalls and said base end wall.

14. The assembly of claim 13 wherein said support rail includes a securing insert section received in said second channel portion of said securing section having a complementary shape to said securing section for flush engagement with said securing sidewalls; wherein said securing insert section is recessed from said base insert section in a complementary arrangement to said securing track to define a support ledge at the intersection of said base insert section and said securing insert section so that said retaining ledge engages said support ledge to retain said base insert section in said first channel portion of said securing track.

15. The assembly of claim 14 wherein said symmetrical securing sidewalls of said securing track are rounded inward from said base sidewalls to form a shoulder recess between said base section and said first securing lip and said second securing lip, respectively, on opposing sides of said securing track.

16. The assembly of claim 15 wherein said securing insert section has a complementary rounded shape to said securing sidewalls of said securing track to form a rounded shoulder for being received in said shoulder recess in flush engagement.

17. The assembly of claim 9 including a second support rail carried at an opposite distal end of said decorative trim element in an inverted orientation to the first said support rail for engaging a securing track so that said trim module includes a top support rail and a bottom support rail.

18. The assembly of claim 17 including a double track having a first securing track and a second securing track symmetrically arranged back to back so that said trim module opening of said first securing track is disposed on a top side and said trim module opening of said second securing track is disposed on a bottom side.

19. The assembly of claim 18 wherein said first securing track of said double track engages said bottom support rail of said trim module so that said top rail of another said trim module can be inserted into said second securing track for a double hung arrangement.

20. The assembly of claim 9 including an end cap for being carried at a distal end of said securing track to resist said trim module from sliding out of said securing track, wherein said end cap includes a cap insert portion having a complementary shape to said base section and said securing section for being received in said first and second channel portions of said securing track in a friction fit arrangement.

* * * * *